US005397253A

United States Patent [19]

Fries

[11] Patent Number: 5,397,253

[45] Date of Patent: Mar. 14, 1995

[54] HIGH CURRENT CONTACT FOR ELECTRICAL PLUG-IN CONNECTORS

[75] Inventor: Helmut Fries, Niederdreisbach, Germany

[73] Assignee: ELCO Europe GmbH, Betzdorf, Germany

[21] Appl. No.: 65,085

[22] Filed: May 20, 1993

[30] Foreign Application Priority Data

May 21, 1992 [DE] Germany ..... 42 16 809.0

[51] Int. Cl.[6] ..... H01R 13/05

[52] U.S. Cl. ..... 439/825; 439/824

[58] Field of Search ..... 439/825, 700, 842, 843, 439/851-857, 692, 824

[56] References Cited

U.S. PATENT DOCUMENTS

| | | | |
|---|---|---|---|
| 3,031,641 | 4/1962 | Camzi | 439/825 |
| 3,634,819 | 11/1972 | Evans . | |
| 4,082,411 | 4/1978 | Storck | 439/843 |
| 4,619,496 | 10/1986 | Forney, Jr. et al. | 439/434 |
| 4,662,706 | 5/1987 | Foley | 439/843 |
| 5,026,301 | 6/1991 | Balyansy et al. | 439/825 |
| 5,147,229 | 9/1992 | Nestor | 439/843 |

FOREIGN PATENT DOCUMENTS

| | | |
|---|---|---|
| 338907 | 9/1977 | Austria . |
| 829755 | 1/1952 | Germany . |
| 925595 | 3/1955 | Germany . |
| 2348645 | 3/1973 | Germany . |
| 3518030 | 5/1985 | Germany . |

*Primary Examiner*—David L. Pirlot
*Attorney, Agent, or Firm*—Anderson Kill Olick & Oshinsky

[57] ABSTRACT

A high current connector for electrical plug-in contact devices is disclosed which has a sleeve or tubularly-shaped press-fit portion, which is provided with a relatively long jacket area, which is bulged in a barrel-shaped manner, between two short cylindrical jacket areas. A press-fit portion of the connector member is located on the bulged jacket area.

13 Claims, 1 Drawing Sheet

HIGH CURRENT CONTACT FOR ELECTRICAL PLUG-IN CONNECTORS

FIELD OF THE INVENTION

The present invention pertains to a high current contact for electrical plug-in connectors.

BACKGROUND OF THE INVENTION

Electrical plug-in connectors, which are equipped with high current contacts, are required for supplying electric current to electronic apparatuses, so that currents having a high current density can also be transmitted problem-free, and especially, with low heat generation and low losses. It is important to be able to transmit the current in the region of an electrical connector arrangement which has a sufficiently wide conductor cross-section.

SUMMARY OF THE INVENTION

The object of the present invention is to provide a plug-in connector, which is fabricated using press-fit technology, such as that press-fit technology which is referred to in U.S. Pat. No. 4,045,868, and which has contacts which carry high currents and which are formed as a sleeve or a tubularly-shaped insert member. The insert member has a relatively long barrel-shaped jacket area and is located between two short cylindrical jacket areas or segments. The press-fit portion of the insert member is formed by the barrel-shaped jacket area.

It has been shown that high current connectors, which are designed in such a way, are particularly suitable for being used in electronic apparatuses which are equipped with integrated circuit building blocks, and especially, highly integrated circuits, which operate with very thin sputtered strip conductors or copper tracks.

According to the invention, a jacket area, which tapers in a cone-shaped manner, is provided at a free end of the insert member, upstream of the respective slotted cylindrical jacket area, wherein both jacket areas have preferably the same length.

It has been proven to be advantageous, in actual practice, to provide a radius of curvature for the barrel-shaped jacket area of the insert member, which is dimensioned so as to be larger than the overall length of the insert member. It has also been proven to be advantageous, if the two short cylindrical jacket areas have identical external diameters, but preferably different lengths. In this regard, the short cylindrical jacket area, which is adjacent to the free end of the insert member, can have a larger length dimension than the second short cylindrical jacket area of the insert member, which terminates with a transition radius at the adjacent contact segment, which radius has a ratio of approximately 2:5 with the length of the first short cylindrical jacket area.

According to an additional refinement of the invention, it is advantageous if the insert member of the high current connector is designed to be at least diametrically slotted along a substantially large portion of its length.

In some cases, however, it is more advantageous, if the insert member is designed so as to be slotted crosswise along a substantial portion of its length.

It is also desirable, in order to assure better cross-over resistances, if at least the press-fit portion of the barrel-shaped jacket area, of the insert member, is provided with a roughening, or rippling region or the like.

High current connectors have been proven to be particularly successful, in actual practice, when their insert members are designed with a diameter to length ratio of approximately 0.65:1, when the diameter ratio of the barrel-shaped jacket area to the short cylindrical jacket area is approximately 1:1.16, and when the ratio of the length of the insert member to the length of its barrel-shaped jacket area is approximately 1.43:1.

However, it is also important, within the framework of the present invention, to design the high current connector in such a way, that the internal diameter of the sleeve or tubularly-shaped insert member has a ratio of approximately 0.62:1 with its largest external diameter, while the short cylindrical jacket area, which is adjacent to the free end of the insert member, has a larger length dimension than the rear short cylindrical jacket area so that these jacket areas have a length ratio of, preferably, approximately 1.66:1.

In the above described high current connector, the sleeve or tubularly-shaped insert member has a length dimension of 5 mm and a largest diameter, at its barrel-shaped jacket area, of 3.25 mm. In this case, the diameter of the short cylindrical jacket area is 2.8 mm and the internal diameter of the sleeve or tubularly-shaped insert member is 2 mm.

Accordingly, it is an object of the present invention to provide a plug-in connector which is fabricated using pressfit technology and which has contacts which carry high currents and which are formed as a sleeve or tubularly-shaped insert member, which has a relatively long barrel-shaped jacket area, and which is located between two short cylindrical jacket areas or segments, and wherein the press-fit portion of the insert member is formed by the barrel-shaped jacket area.

Other objects and advantages of the present invention will be apparent to those persons skilled in the art upon a review of the Description of the Preferred Embodiment taken in conjunction with the Drawings which follow.

DESCRIPTION OF THE PREFERRED EMBODIMENT

Figure 1:
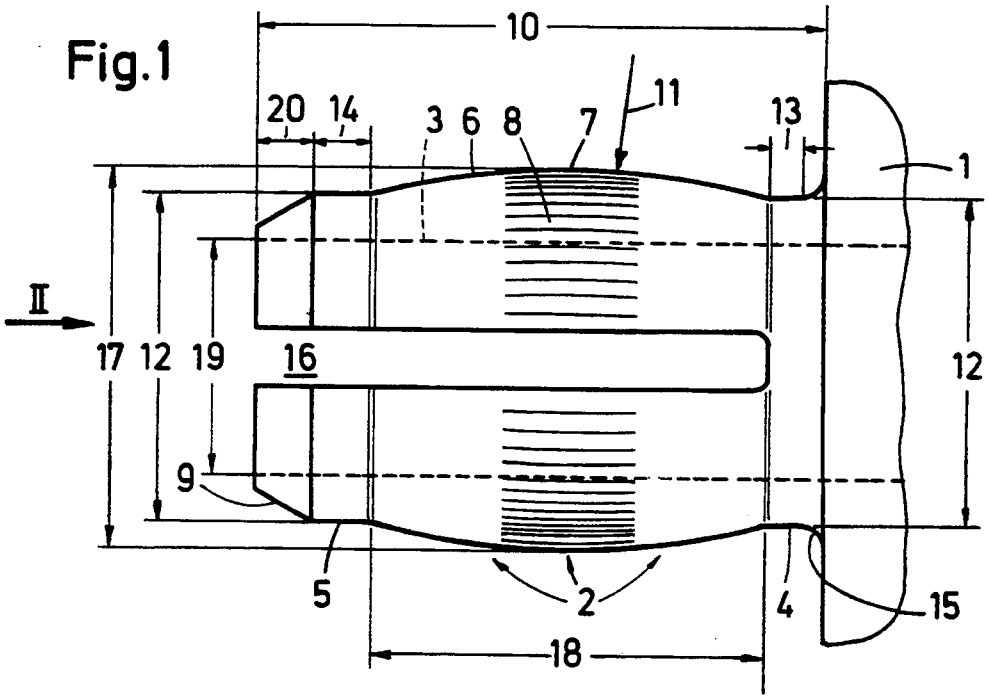
FIG. 1 illustrates a magnified side view of a high current connector which is the subject of the present invention and which is suitable for utilizing press-fit technology.

FIG. 1 illustrates a portion of a high current connector 1, which may be utilized in electronic plug-in contact devices and which may be a part of the essential equipment of an electronic apparatus. The high current connector 1 is produced by press-fit technology techniques and is therefore provided with an insert member 2, which is preferably fabricated in one piece with, or integrally with, the high current connector 1 and which is made from the same material as the connector 1.

The insert member 2 has essentially a sleeve or tubularly-shaped form, which is obtained by forming a molded therein cylindrical central channel 3.

FIG. 1 also illustrates that the sleeve or tubularly-shaped insert member 2 comprises two short cylindrical jacket areas 4 and 5 between which a relatively long barrel-shaped jacket area 6 is located.

The press-fit portion 7 of the insert member 2 is also located at this jacket area 6. The press-fit portion 7 is characterized, in the illustrated embodiment, by its surface having a roughening or a rippling region 8 or the like.

A jacket area 9, which tapers in a cone-shaped manner, is located upstream of the cylindrical jacket area 5, at the free end of the insert member 2, wherein, preferably the lengths of the two jacket areas 5 and 9 are identically dimensioned.

It has also been proven to be advantageous, in actual practice, to provide the jacket area 6, of the insert member 2, with a radius of curvature which is greater than the overall length 10 of the insert member 2. In an embodiment of the high current connector 1, which is used in actual practice, the radius of curvature 11 of the jacket area 6 can, for instance, have a ratio of approximately 1.38 to 1 with the overall length 10 of the insert member 2.

It is also possible that the two cylindrical jacket areas 4 and 5 may have the same external diameter 12, but that they may have lengths 13 and 14 which are different from one another. The cylindrical jacket area 4, of the insert member 2, is provided with a transition radius 15 as it transitions into the high current contact 1. The transition radius 15 is preferably dimensioned, in such a way, so that its size is approximately 60% of the length 13 of the cylindrical jacket area 4. The length 13 of the cylindrical jacket area 4 is approximately 60% of the length 14 of the cylindrical jacket area 5.

Figure 2:
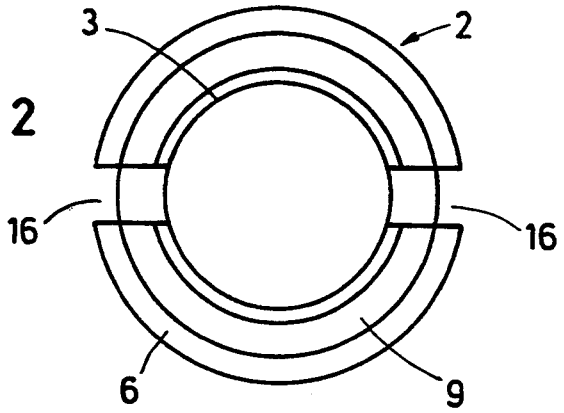
FIG. 2 illustrates an end view of the connector of FIG. 1 in the direction of arrow II.

It can be seen from FIGS. 1 and 2 that the insert member 2, of the high current contact 1, is provided with two diametrically oriented slots 16, along the largest portion of its length, which provide a certain flexural effect to the insert member 2.

Figure 3:
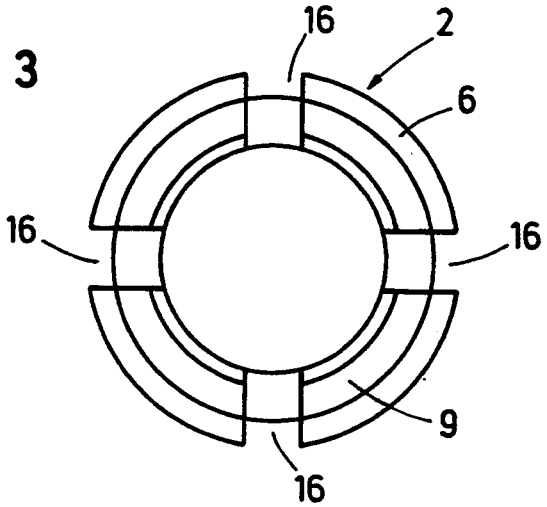
FIG. 3 illustrates an end view which corresponds to that of FIG. 2 for an alternate embodiment of the insert member which is utilized in the connector of FIG. 1.

In some cases, it is even more desirable, to provide cross-wise slots 16 in the insert member 2, as is illustrated in FIG. 3.

In the embodiment illustrated in FIG. 1, the insert member 2, of the high current contact 1, is shaped in such a way, that its largest possible diameter 17 has a ratio of approximately 0.65:1 with its length 10. This means, for instance, that, with a largest possible diameter 17 of the insert member 2, its length 10 can be approximately 5 mm.

It is also possible that the diameter 17 of the jacket area 6 can have a ratio, to the external diameter 12 of the two cylindrical jacket areas 4 and 5, which is approximately 1.16:1, while the overall length of the insert member 2 can have a ratio of approximately 1.43:10 with its jacket area 6.

It is also possible, for the internal diameter 19 of the sleeve or tubularly-shaped insert member 2, to have a ratio of approximately 0.62:1 with its largest external diameter 17, and that its dimension is, therefore, approximately 2 mm if the external diameter 17 has a dimension of 3.25 mm.

Finally, it should be noted, that the jacket area 9, which tapers in a cone-shaped manner, is preferably provided with a length 20, at the free end of the insert member 2, which is equal to the length 14 of the adjoining cylindrical jacket area 5.

High current connectors 1, which have the sleeve or tubularly-shaped insert members 2, which have the design described above, have been illustrated as being particularly suitable for transmitting, or for carrying, currents which have a high current density. In this regard, they achieve considerably improved transition or cross-over resistances in the area of their press-fit portions, especially if the press-fit portions are provided with a roughening or a rippling region or the like.

While the present invention has been described in various preferred embodiments, such descriptions are merely illustrative of the present invention and are not to be construed as limitations thereof. In this regard, the present invention is meant to encompass all modifications, variations and/or alternate embodiments with the scope of the present invention limited only by the claims which follow.

What is claimed is:

1. A high current connector for electrical plug-in contact devices connectable to integrated circuit components, especially printed circuit boards, comprising:

an insert member, wherein said insert member is at least one of a sleeve and a tubular shape, and further wherein said insert member is at least one of a pressed-in and a force-fitted segment of said connector, wherein said insert member contains a molded-in cylindrical central channel, and further wherein said insert member further comprises:

two short cylindrical jacket areas, and a jacket region located between said two short cylindrical jacket areas, wherein said jacket region is barrel-shaped, and further wherein one of a press-fitted portion and a force-fitted portion is located on said jacket region, wherein one of said at least two short cylindrical jacketed areas has at least one slot therethrough.

2. The high current connector of claim 1, wherein said insert member has a jacket area which tapers in a cone-shaped manner at a free end thereof and upstream of at least one of said two short cylindrical jacket areas, and wherein said at least one of said two short cylindrical jacket areas and said jacket area which tapers have a same length.

3. The high current connector of claim 1, wherein said barrel-shaped jacket area has a radius of curvature which is greater than an overall length of said insert member.

4. The high current connector of claim 1, wherein said two short cylindrical jacket areas have identical external diameters and different lengths.

5. The high current connector of claim 1, wherein said insert member has diametrically opposite slots along a substantial portion of its length.

6. The high current connector of claim 1, wherein said insert member has two pairs of diametrically opposite slots along a substantial portion of its length, wherein said pairs of slots are located about a circumference of said insert member.

7. The high current connector of claim 1, wherein at least said press-fit portion of said insert member is provided with at least one of a roughening and a rippling region.

8. The high current connector of claim 1, wherein said insert member has a diameter to length ratio of approximately 0.65:1.

9. The high current connector of claim 1, wherein a ratio of the diameters of said barrel-shaped jacket area to at least one of said two short cylindrical jacket areas is approximately 1.16:1.

10. The high current connector of claim 1, wherein the ratio of an overall length of said insert member to a length of said barrel-shaped jacket area is 1.43:1.

11. The high current connector of claim 1, wherein the ratio of an internal diameter of said insert member to a largest external diameter thereof is approximately 0.62:1.

12. The high current connector of claim 1, wherein a first of said two short cylindrical jacket areas, which is adjacent to a free end of said insert member, has a length which is greater than a second of said two short cylindrical jacket areas, and wherein the ratio of their lengths is approximately 1.66 to 1.

13. The high current connector of claim 1, wherein said insert member has two pairs of diametrically opposite slots along a substantial portion of its length, wherein said pairs of slots are located symmetrically cross-wise about a circumference of said insert member.

* * * * *